United States Patent [19]

Fricker

[11] 4,173,856

[45] Nov. 13, 1979

[54] ANCHOR FOR THE TILT-UP AND TRANSPORT OF PREFABRICATED BUILDING COMPONENTS

[76] Inventor: Siegfried Fricker, Wurmberger Strasse 30-34, 7135 Wiernsheim, Fed. Rep. of Germany

[21] Appl. No.: 874,815

[22] Filed: Feb. 3, 1978

[30] Foreign Application Priority Data

Feb. 3, 1977 [DE] Fed. Rep. of Germany ..... 2704435
May 5, 1977 [DE] Fed. Rep. of Germany ..... 2720148

[51] Int. Cl.[2] ..... E04B 21/12
[52] U.S. Cl. ..... 52/125; 52/699; 248/499; 294/89
[58] Field of Search ..... 52/125, 124, 699–714; 403/117; 248/499, 500, 505; 85/63; 294/89

[56] References Cited

U.S. PATENT DOCUMENTS

| | | | |
|---|---|---|---|
| 1,080,002 | 12/1913 | Dare | 52/714 |
| 1,984,211 | 12/1934 | Haase | 52/698 |
| 3,883,170 | 5/1975 | Fricker et al. | 24/239 |

FOREIGN PATENT DOCUMENTS

| | | | |
|---|---|---|---|
| 27694 | 3/1964 | German Democratic Rep. | 52/125 |
| 787698 | 12/1957 | United Kingdom | 52/700 |

*Primary Examiner*—James L. Ridgill, Jr.
*Attorney, Agent, or Firm*—Joseph A. Geiger

[57] ABSTRACT

Anchor element for the tilt-up and transport of prefabricated building components, particularly prefabricated wall panels, in cooperation with a hoisting shackle of the type having a torus-shaped body and a retractable arcuate locking bolt engaging a bolt hole in the exposed end portion of the anchor element, the latter defining a bridge portion between its bolt hole and its outer extremity and, as part of the bridge portion, one or two integral longitudinal extensions of the anchor element which reach beyond the bridge portion and have two oppositely oriented force-transmitting surfaces one of which engages a surface of the hoisting shackle body during tilt-up, thereby preventing pivoting of the shackle body against the concrete recess which surrounds the exposed portion of the anchor element. The anchor element with two laterally spaced integral extensions engages the sides of the shackle body, and the anchor element with a central integral extension engages an aperture in the shackle body.

20 Claims, 13 Drawing Figures

VIII
IX
XII
d-d

ANCHOR FOR THE TILT-UP AND TRANSPORT OF PREFABRICATED BUILDING COMPONENTS

BACKGROUND OF THE INVENTION

1. Field of the Invention

The present invention relates to hoisting attachments and, more particularly, to anchor members which are permanently imbedded in prefabricated concrete building components for the attachment thereto of hoisting means capable of lifting and transporting the building components.

2. Description of the Prior Art

The use of prefabricated building components of reinforced cast concrete has become widely accepted in the construction industry. For economic reasons, the preferred way of producing and installing these building components is to have a centralized place of production, a prefabrication factory, where the components are produced, and to then transport the finished building components to the construction site. For the production of large concrete panels and frames, such as wall members, for example, such a prefabrication factory would be equipped with a hydraulically tiltable casting table which allows for the wall members to be lifted from the table in the upright orientation in which the prefab members are then transported to the construction site. The tiltability of the casting table greatly simplifies the hoisting problems, making it possible to use simple traction anchors in the upper narrow face of the wall member. This means that, immediately after production, the wall member is placed in an upright or near upright orientation in which it can be lifted and transported in the same manner as a prefabricated beam, for example.

There are many situations, however, in which a tiltable casting table is unavailable, especially when the wall members are to be cast at the construction site itself. Under these circumstances, it becomes necessary to tilt the finished wall member into the upright position by raising it on that edge which will later be the upper edge of the member, using suspension-type lifting equipment, such as a construction crane, for example. It is, of course, desirable to utilize for this purpose the same anchor elements in the narrow face at the upper edge which also serve for the hoisting and handling of the wall member, after it has been tilted up.

A major problem with this approach lies in the requirement that the anchor elements be set below the level of the edge face, inside a suitable recess, which is open in the direction perpendicular to that face. This means that, in the horizontal position of the prefabricated member, the attachment gear, after connection to the anchor element, will pull at a right angle to the normal direction of pull, tending to break away the narrow concrete ledge between the anchor element recess and the edge above it, or to break out the embedded anchor element altogether. Naturally, this problem is particularly acute in the case of thin wall members, where the ledges in question are very narrow.

While it is possible to prevent the lateral breakout of the anchor elements by means of suitable reinforcing rods or legs which increase the bearing surface of the anchor element appropriately, it is very difficult to arrange the hoisting attachment in such a way that the shackle part of the equipment which is connected to the embedded anchor element be pivotable in the sense toward the second anchor, but not in the direction of tilt-up pull.

A hoisting attachment of the type mentioned is disclosed in U.S. Pat. No. 3,883,170, the attachment consisting of an anchor element which is permanently embedded in the concrete member and a clasp-like hoisting shackle with a slot and an arcuate locking bolt which cooperates with an exposed eye portion of the anchor member to produce a secure connection. Because it is in most cases necessary that the anchor element be recessed below the surface of the prefabricated member, the latter has to have a suitable elongated recess surrounding the exposed eye portion of the anchor element, the recess having a shape which closely matches the ring-shape of the body of the hoisting shackle.

The exposed eye portion of the anchor element, when engaged in the attachment slot of the hoisting shackle and locked in place by its arcuate locking bolt, prevents the hoisting shackle from pivoting in the longitudinal sense of the concrete member, but allows pivoting movements in the transverse or lateral sense, about an axis which is defined by the hole in the anchor element eye portion and the engaged locking bolt. This lateral pivotability of the hoisting shackle is of no consequence, when the pull of the hoisting harness is in a plane which coincides with the longitudinal axis of the embedded anchor element. However, in the case of a horizontally oriented wall plate, for example, the anchor element, or elements, are initially embedded in a horizontal orientation, their exposed eye portions and access recesses being arranged in the vertical narrow face of the member. This means that the hoisting shackle, when attached to the anchor element, extends likewise horizontally away from the vertical face of the wall member.

It should be evident from this description that, if the hoisting harness, in an attempt to tilt the wall member into an upright orientation, exerts an upward pull on the hoisting shackle, the latter will pivot under this force until one side of the shackle body engages the upper side wall of the recess in the concrete member. In many cases, especially when the wall member is comparatively thin, this situation leads to the breakaway of the concrete against which the shackle body is being pressed.

While the prior art solution proposes an embodiment in which the eye portion of the anchor element has a pointed outline with an obtuse crest angle engaging an attachment slot of the hoisting shackle with an approximately matching angled bottom end, this attachment configuration, though seemingly restricting the pivotability of the hoisting shackle in the lateral sense, is unsuitable for tilt-up operations. The two faces on the exposed eye portion of the anchor element and the two faces at the bottom of the attachment slot of the shackle body are so close to a tangent line on the pivot center, i.e. the hole of the eye portion, that the creation of a pivotability-restricting force of sufficient magnitude is impossible.

It has therefore already been suggested to utilize special tilt-up anchor elements in combination with the above-described hoisting shackle, each anchor element having welded to its exposed eye portion a cradle-like collar piece which wraps around the shackle body on opposite sides of its attachment slot, thereby restricting its pivotability as required for a tilt-up operation. This composite anchor element is complex in structure and comparatively costly to manufacture.

Another prior art hoisting attachment features a permanently embedded anchor element which has a ball-shaped exposed extremity which is being engaged by a hoisting shackle with a matching cavity and a locking mechanism engaging the ball-shaped end. Here again, the pivotability provided by the ball-shaped exposed portion of the anchor element allows for the hoisting shackle to pivot against the concrete forming the wall of the recess, thereby tending to break away that concrete, when the hoisting attachment is used in a tilt-up mode of operation.

In order to solve this problem, it has therefore been suggested that a specially modified hoisting shackle be used which includes a plate which, by supporting itself against the outer surface of the concrete wall member, prevents the hoisting shackle from pivoting into contact with the concrete. While this solution has the disadvantage of covering the recess around the anchor elements, thus preventing visual inspection of the attachment mechanism, it also has the disadvantage of greatly increasing the traction on the attachment mechanism itself, as a result of the pressure of the special shackle plate against the concrete surface.

Still another prior art hoisting attachment features an anchor element with a male thread on its exposed length portion, which is to be engaged by a hoisting shackle with a matching female thread. Here, too, special provisions have to be made to prevent the surrounding concrete from breaking away under excessive stress. The solution proposed in this case is similar to the one previously described, namely a special plate added to the hoisting shackle which bears against the concrete member from the outside.

It has also been suggested that such an exterior supporting plate, preferably U-shaped, be attached to the anchor element itself. However, this approach is very costly, because it means that each anchor element has to be equipped with such a plate which cannot be recovered after use.

Lastly, there is also in use a hoisting attachment which features a tubular anchor element with a free cavity underneath the embedded extremity of the element. The cooperating hoisting shackle has a matching member which reaches through the hollow anchor element, locking itself against the latter by means of a locking head with radially movable members occupying the cavity behind the anchor element. While this approach does not require that a portion of the anchor element be exposed inside a surrounding recess in the concrete member, thereby eliminating the difficulties caused by a recess in connection with tilt-up operations, the necessity of a cavity behind the embedded extremity of the tubular anchor element involves offsetting disadvantages, especially as regards the impossibility of a visual inspection of the locking action of the hoisting shackle and the risk that gravel and/or water may be found in the cavity, the latter being particularly dangerous at freezing temperatures.

SUMMARY OF THE INVENTION

Underlying the present invention is the primary objective of devising an improved anchor for the tilt-up and transport of prefabricated concrete building components, especially prefabricated wall members which, while being inexpensive to manufacture, is free of most or all of the prior art disadvantages which are mentioned further above. Another objective of the invention is to propose an attachment configuration in which the hoisting member is usable for both tilt-up operations and routine hoisting operations which do not require a change in the orientation of the prefabricated building component. The attachment action between the embedded anchor element and the hoisting shackle is to be controllable visually and the exposed portion of the anchor is to be as unaffected as possible by extreneous matter, such as water and construction grime. Lastly, the proposed tilt-up and transport anchor is to be as simple as possible in structure and suitable for mass production at low cost.

The present invention proposes to attain these objectives by suggesting an anchor element for use in conjunction with a hoisting shackle of the type having a generally annular body inside which an arcuate locking bolt is engageable across an attachment slot, the anchor element being preferably die-cut from flat stock, having an anchoring portion with laterally extending retaining legs embedded in the concrete of the prefab component, and an exposed end portion with a transverse bolt hole delimiting a bridge portion between it and the outer extremity. The bridge portion includes at least one integral longitudinal extension of the anchor element with two forcetransmitting surfaces facing in approximately opposite directions, whereby one or the other of the force-transmitting surfaces engages the body of the attached hoisting shackle so as to restrict it against pivoting about the pivot axis defined by the locking bolt and bolt hole, when the shackle is pulled in a direction which creates such a pivoting tendency, as would be the case in a tilt-up operation.

The integral extension or extensions, respectively, thus reach a certain distance beyond the base of the bridge portion of the anchor element, in order to define the two forcetransmitting surfaces. The exposed end portion of the anchor element is preferably surrounded by a recess in the narrow face of the prefab component, so that no part thereof protrudes from the narrow outer surface of the component. This recess is in many cases filled in, after installation of the component, thereby completely hiding the anchor element. In addition to the advantages stated further above, this type of anchor element has thus only a minimal surface area exposed to corrosion. The novel anchor element is also suitable for use in connection with heavy components of plastic material, or even metal, where the panel portion holding the anchor element is similarly susceptible to deformation and damage during tilt-up or pivoting operations.

In a preferred embodiment of the invention, the bridge portion of the anchor element is either ridge-shaped or arched about the bolt hole, having two integral extensions arranged on opposite sides of the anchor axis, in alignment with the outer edges of the anchor element, so as to present two inwardly facing force-transmitting surfaces. The distance between the latter is such that the body of the hoisting shackle fits loosely therebetween, so that the hoisting shackle is prevented from rotating about its locking bolt, relative to the anchor element. For this purpose, the body of the hoisting shackle has appropriate outwardly facing force-transmitting surfaces which are either flush with the sides of the shackle body, or raised in the manner of cam surfaces, or recessed in appropriate grooves.

In another preferred embodiment of the invention, the anchor element has a single, centrally arranged integral extension with laterally outwardly facing force-transmitting surfaces, the extension cooperating with a central aperture of the shackle body which forms matching cooperating force-transmitting surfaces. This aperture in the shackle body is preferably a rectangular hole extending between its attachment slot and its central opening.

While it is convenient to arrange the cooperating force transmitting surfaces parallel to each other and to the central axis of the anchor element, it is also possible to arrange these surfaces at an angle, for easier engagement of the hoisting shackle over the anchor element.

The anchor element, being of the so-called "lost anchor" type, has its major length portion embedded in the concrete of the prefab component. For this purpose, the embedded end portion of the anchor element is preferably longitudinally split into two laterally inclined leg portions. In addition, the anchor element may have one or more transverse holes and/or edge recesses in its anchoring portion for the engagement therewith of suitable reinforcing rods which assist in the transmission of the transversely oriented tilt-up forces from the anchor element to the body of the concrete wall member.

BRIEF DESCRIPTION OF THE DRAWINGS

Further special features and advantages of the invention will become apparent from the description following below, when taken together with the accompanying drawings which illustrate, by way of example, several embodiments of the invention, represented in the various figures as follows.

DESCRIPTION OF THE PREFERRED EMBODIMENTS

Figure 1:
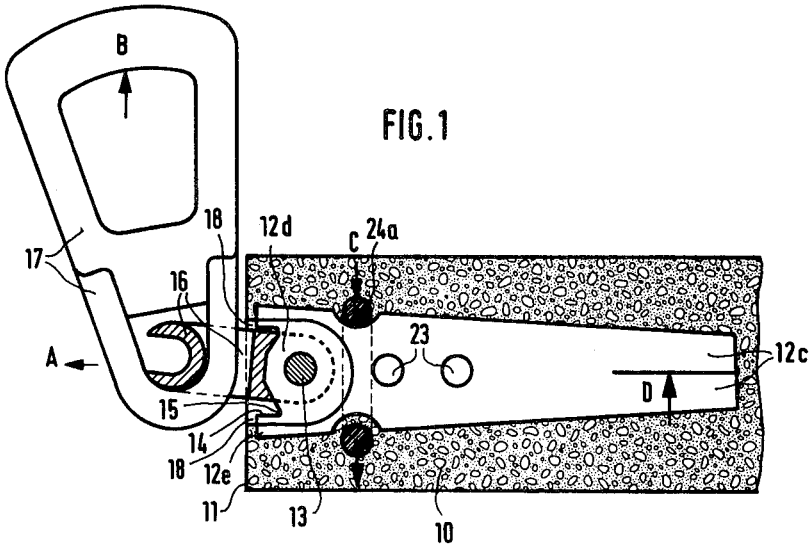
FIG. 1 shows an elevational cross section of a portion of a prefabricated building component with an anchor element of the present invention embedded therein and a hoisting shackle attached to the exposed end portion of the anchor element, the hoisting shackle being subjected to a lifting force in the sense of a tilt-up operation.
Figure 2:
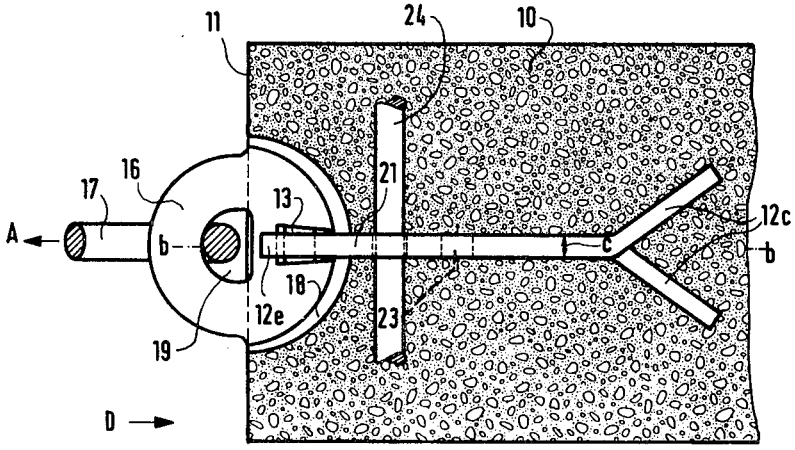
FIG. 2 shows the components of FIG. 1 in a plan view, with the concrete building component longitudinally cross-sectioned to expose the anchor element and the attached hoisting shackle.

Referring to FIGS. 1–5 of the drawing, there is shown an anchor element 12 representing a first embodiment of the present invention. In FIGS. 1 and 2, the anchor element is shown embedded in the narrow side of a horizontally oriented prefabricated building component or wall member 10, a hoisting shackle 16, 17 being releasably attached to an exposed end portion of the anchor element 12. The hoisting shackle in question is known from U.S. Pat. No. 3,883,170.

Figure 3:
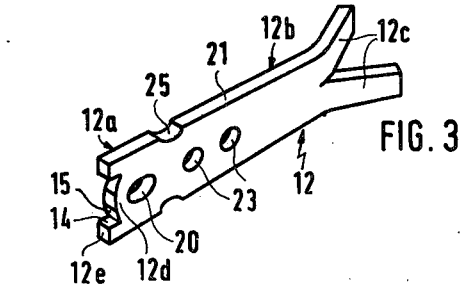
FIG. 3 shows the anchor element of FIGS. 1 and 2 in a perspective view.
Figure 4:
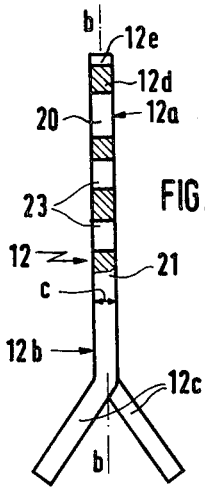
FIG. 4 shows the same anchor element in a side view and partially in longitudinal cross section.
Figure 5:
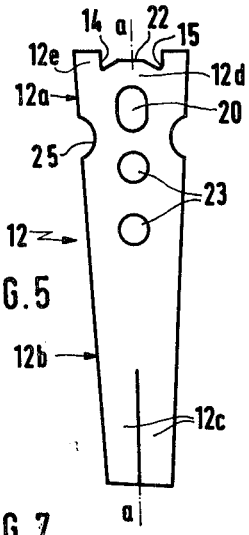
FIG. 5 shows the anchor element in a plan view.
Figure 6:
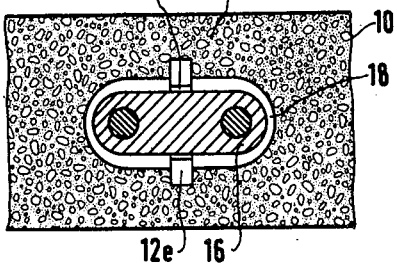
FIG. 6 is an end view of the tilt-up assembly in the direction of arrow D of FIG. 2, the hoisting shackle being shown in cross section.

As can be seen in FIGS. 3–5, the anchor element 12 is a flat member, preferably die-cut from steel stock of thickness c (FIG. 4), the lower end portion of the anchor element being split longitudinally along the anchor axis a—a to form two anchoring legs **12*c* which are bent laterally away from the central plane b—b of the anchor element. In the central portion of the anchor body are arranged two transverse openings 23 for the engagement therethrough of appropriate reinforcing rods 24 (FIG. 2). The retention of the anchor element 12 in the wall member 10 is further assisted by means of two rounded recesses 25 in the longitudinal edges 21 of the anchor body. Into these recesses are engaged oppositely bent reinforcing rods 24*a*. The edge recesses 25 are located longitudinally between the central openings 23 and a bolt hole 20 which is to be engaged by the arcuate locking bolt 13 of the hoisting shackle body 16. The reinforcing rods 24*a* thus serve to transmit tilt-up lifting forces from the anchor element 12 to the surrounding concrete of the wall member 10. The combined anchoring action of the reinforcing rods 24, 24*a*, and of the anchoring legs 12*c* gives the anchor element 12 a very solid connection with the wall member 10, providing a force distribution inside the latter which eliminates all risk of damage to the surrounding concrete during both tilt-up and vertically oriented hoisting and handling of the wall member 10**.

Figure 7:
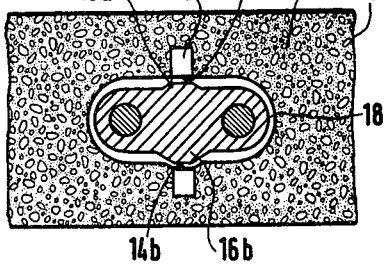
FIG. 7 is similar to FIG. 6, showing two different possibilities of the arrangement of the cooperating force-transmitting surfaces of the anchor element and hoisting shackle.
Figures 8, 9, 10, 11, 12, 13:
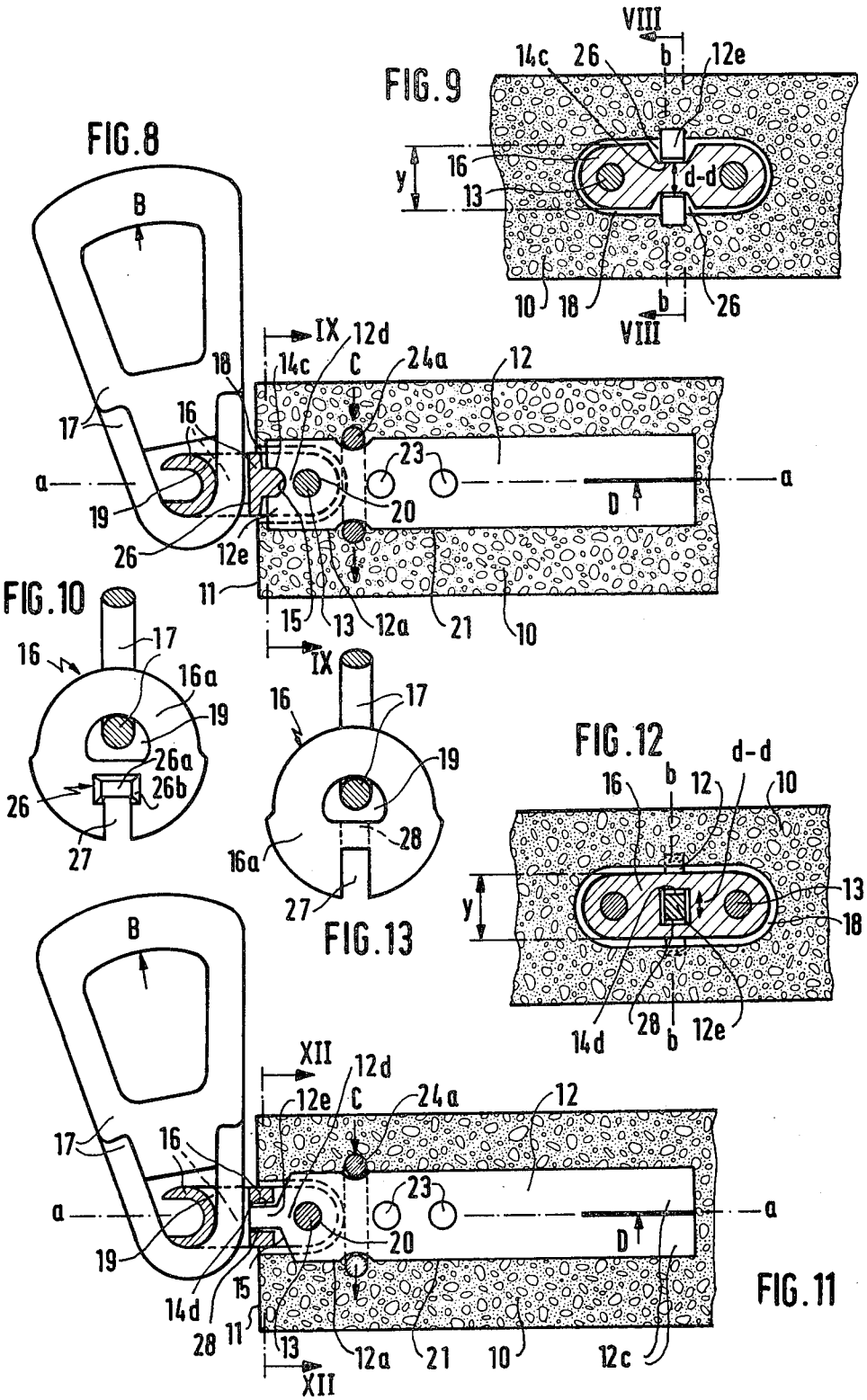
FIG. 8 is similar to FIG. 1, showing a different embodiment of the anchor element and cooperating hoisting shackle, as seen in an elevational cross section taken along line VIII—VIII of FIG. 9.
FIG. 9 is a cross section of the assembly of FIG. 8, taken along line IX—IX thereof.
FIG. 10 shows the hoisting shackle of FIGS. 8 and 9.
FIG. 11 is similar to FIGS. 1 and 8, showing a third embodiment of the anchor element cooperating with a modified hoisting shackle.
FIG. 12 is a cross section of the assembly of FIG. 11, taken along line XII—XII thereof.
FIG. 13 shows the hoisting shackle of FIGS. 11 and 12 in a side view.

The anchor element 12 is preferably so embedded inside the concrete of the wall member 10 that its exposed end portion **12*a* does not protrude over the outer surface 11 of the narrow side of the wall member 10 (FIGS. 1–10), or that such protrusion is only minimal (FIGS. 11–13). For this purpose, the exposed end portion 12*a* of the anchor element 12 is arranged inside a rounded recess 18 in the narrow side of the wall member 10, a portion of the cooperating hoisting shackle body 16 fitting into the recess 18**, without touching the side walls of the latter.

The exposed end portion **12*a* of the anchor element 12 consists essentially of a bridge portion 12*d* between the bolt hole 20 in the center axis a—a of the anchor element 12 and its outer extremity. Accordingly, there is a minimum of surface area of the anchor element 12 exposed to corrosion. These exposed surface areas can be conveniently covered, following final installation of the wall member 10, by filling in the recess 18**.

The exposed end portion **12*a* of the anchor element 12 fits into an attachment slot 27 (FIG. 10) of the hoisting shackle body 16, so that the bolt hole 20 of element 12 can be brought into alignment with the guide channel of a retractable arcuate locking bolt 13 of the hoisting shackle 16. The engagement of the locking bolt 13 through the bolt hole 20** can be visually controlled and inspected during and after the attachment procedure.

The anchor element 12 is preferably die-cut from flat stock, either with tapering longitudinal edges 21, as shown in FIGS. 3–5, or with parallel longitudinal edges 21, as shown in FIGS. 8 and 11. In the latter case, the anchor element is preferably fabricated from rod stock of rectangular cross section.

In the embodiment of FIGS. 1–7, the bridge portion 12*d* of the anchor element 12 is flanked on opposite sides of the anchor axis a—a by two integral extensions 12*e* which reach above the base of the bridge portion 12*d*, thereby defining oppositely inwardly facing force-transmitting surfaces 14. The outer edges of the integral extensions 12*e* are preferably aligned with the longitudinal edges 21 of the anchor element 12. As can be seen in FIG. 1, the force-transmitting surfaces 14 of the extensions 12*e* are designed to be engaged by cooperating force-transmitting surfaces on the outer side of the shackle body 16, thereby preventing pivoting of the hoisting shackle against the wall of the recess 18 of the wall member 10, under a tilt-up lifting force in the direction of arrow B.

The upper contour of the bridge portion 12*d* is preferably either ridge-shaped or arched around the bolt hole 20, having a flat midportion 22 in the area of the anchor axis a—a. The attachment slot 27 of the hoisting shackle body 16 has a roughly matching bottom contour (FIG. 1).

The asymmetric representation in FIG. 7 shows, in its lower half, a force-transmitting surface 14*b* of the integral extension 12*e* which is laterally recessed with respect to the adjoining side wall of the concrete recess 18, while the upper half of the figure shows a force-transmitting surface 14*a* which is flush with the recess side wall. The body of the hoisting shackle 16 has in each case a lateral cam portion 16*a* forming an elevated cooperating force-transmitting surface which assures that the shackle body will only abut against one of the integral extensions 12*e*, and not against the side wall of the recess 18, when the hoisting shackle 16, 17 is pulled transversely to the plane b—b of the anchor element 12, in a tilt-up operation (arrow B of FIG. 1).

In FIGS. 8–10 is illustrated a second embodiment of the anchor element of the invention, the bridge portion 12*d* being again flanked by two integral extensions 12*e* which reach beyond the base 15 of the bridge portion 12*d*. As in the previously described embodiment, the integral extensions 12*e* define oppositely inwardly facing force-transmitting surfaces 14*c* which are designed to abut against cooperating force-transmitting surfaces of the hoisting shackle body 16. However, because the bridge portion 12*e* of this embodiment is considerably shorter, it is no longer arched upwardly, but the two force-transmitting surfaces 14*c* are simply linked by a fillet at the base 15 of the bridge portion. The outer edges of the integral extensions 12*e* are again aligned with the outer longitudinal edges 21 of the anchor member 12 and, because their lateral spacing is reduced, the anchor member 12 itself is preferably a flat rod with parallel edges 21.

In order to accommodate the shortened bridge portion 12*d*, the shackle body 16 has arranged in its sides appropriate groovelike recesses 26 of which the bottom faces serve as force-transmitting surfaces. While the lower entry side of each recess 26 opens into the side of the attachment slot 27 of the shackle body 16, the two recesses preferably stop short of the central opening 19 of the shackle body 16, so as not to weaken the latter unnecessarily. In a tilt-up operation, under a lifting force in the direction of arrow B, the shackle body 16 is again prevented from pivoting about its locking bolt 13 in the bolt hole 20 of the anchor element 12, because one of the force-transmitting surfaces 14*c* of the anchor element engages the shackle body 16 in the bottom face of its lateral groove 26. As can be seen in FIG. 9, the residual width d—d between the bottom surfaces of the lateral grooves 26 is considerably less than the overall width y of the torus-shaped shackle body 16. The lateral flanks 26*b* of the grooves 26 are preferably inclined in the manner of bevels.

In FIGS. 11–13 is illustrated a third embodiment of the invention which features a single integral extension 12*e* of the anchor element 12, in alignment with its longitudinal axis a—a, the extension 12*e* forming two outwardly oppositely oriented force-transmitting surfaces 14*d*. The latter are designed to engage a central aperture 28 of the shackle body 16. The aperture 28 is in the form of a through-hole extending between the attachment slot 27 and the central opening 19 of the shackle body 16 and having preferably a square or rectangular cross section.

As in the previously described embodiments, the cooperating force-transmitting surfaces of the shackle body 16 and of the anchor element 12 are arranged to define a certain amount of lateral clearance, in order to facilitate insertion and removal of the hoisting shackle 16, 17 from the exposed end portion of the anchor element 12. Again, the force-transmitting surfaces of the integral extension 12*e* on the anchor element and of the central aperture 28 of the shackle body 16 cooperate to prevent pivoting of the shackle body against the side wall of the concrete recess 18, in the event of a tilt-up operation with a lifting force in the direction of arrow B. The force-transmitting surfaces of the anchor element 12 and of the shackle body 16 are preferably oriented parallel to one another, but may also be tapered, if desired.

The embodiments of FIGS. 8–10 and FIGS. 11–13, respectively, by making it possible to utilize an anchor element 12 of relatively narrow width, are particularly suited for use in conjunction with thin concrete wall panels and other thin-walled prefabricated building components. As can be seen in FIG. 9 and in FIG. 12, the width of this type of anchor element barely exceeds the maximum width y of the shackle body 16.

An essential advantage which is common to all embodiments of the present invention relates to the fact that the arrangement of the described force-transmitting surfaces between the hoisting shackle body and the integral extension, or extensions, of the anchor element 12 positively prevents the pivoting of the shackle body 16 against the side wall of the concrete recess 18, where concentrated lateral pressure from the shackle body would otherwise cause the narrow concrete ledge alongside the recess to break away. Instead, the transverse forces created by tilt-up are directly transmitted to the anchor element 12, and from the latter to the concrete of the wall member 10, via its reinforcing rods 24 and 24*a*. The same reinforcing rods, assisted by the anchoring legs 12*c* of the anchor element 12, also safely retain the anchor element in the wall member 10, when it is hoisted and transported in the upright orientation.

The novel anchor element and its attachment configuration are thus fulfilling the dual role of tilt-up anchor and of regular hoisting anchor with a minimum of structural complexity. Because of its simplicity, the proposed anchor element is ideally suited for mass production. The cooperating hoisting shackle, even if adapted for use with the proposed tilt-up anchor elements through the arrangement of lateral grooves or of a central aperture, can also be used with regular anchor elements which do not have the special force-transmitting surfaces proposed by the invention, and which are known from U.S. Pat. No. 3,883,170. Thus, it is not necessary to switch hoisting shackles, when prefabricated building components with both types of anchor elements are to be handled by the same hoisting equipment.

It should be understood, of course, that the foregoing disclosure describes only preferred embodiments of the invention and that it is intended to cover all changes and modifications of these examples of the invention which fall within the scope of the appended claims.

I claim the following:

1. An anchor element adapted for use with a hoisting shackle of the type having a shackle body and a locking bolt which is engageable across an attachment opening of the shackle body, for the tilt-up and transport of heavy building components, such as prefabricated concrete wall members, supporting columns, and the like, which, in the course of manufacture, transportation, and installation, may have to be reoriented from a horizontal to a vertical orientation, or vice versa, the anchor element being intended to be permanently embedded in the building component, in such a way that an end portion thereof is exposed within a recess, for attachment of the hoisting shackle, the anchor element comprising:

an elongated element body of which said exposed end portion constitutes a first length portion, with a thickness which matches the width of said shackle body attachment opening, the element body having an adjoining second length portion which serves as an anchoring portion and which includes, for that purpose, means for rigidly retaining the element in the building component, when embedded therein;

a transverse hole in said exposed length portion extending through the thickness of the element body, the hole being of a size to allow insertion of said locking bolt therethrough and arranged at such a distance from the extremity of the exposed length portion that a bridge portion is formed between the hole and the exposed extremity; and said bridge portion includes at least one longitudinal extension of the anchor element body defining at least one force-transmitting surface thereon which is oriented to abut against a cooperating surface portion of the body of the hoisting shackle, when the latter is attached to the anchor element, thereby preventing the hoisting shackle from pivoting about the pivot axis defined by said transverse hole in the exposed anchor portion and the engaged locking bolt, into contact with the wall surrounding said recess, when the shackle is pulled in a direction which creates such a pivoting tendency.

2. An anchor element as defined in claim 1, wherein the anchor element body is a length of a rectangular steel bar, having in its anchoring length portion a central longitudinal cut defining two leg portions which are bent away in opposite directions, to serve as said element retaining means.

3. An anchor element as defined in claim 1, wherein at least the exposed length portion of the anchor element body is substantially symmetrical with respect to a longitudinal center axis of the anchor element; and the bridge portion of the exposed length portion includes an integral extension in alignment with said center axis which defines two outwardly facing force-transmitting surfaces that are engageable by corresponding inwardly facing surfaces of a central aperture in the body of the cooperating hoisting shackle.

4. An anchor element as defined in claim 3, wherein the integral central extension of the anchor element and the aperture of the cooperating hoisting shackle are substantially rectangular in outline.

5. An anchor element as defined in claim 1, further comprising at least one reinforcing rod serving to support and retain the anchor element body during and after embedding in the building component; and wherein the element body has a recess cooperating with each reinforcing rod, so as to position the latter in approximately parallel alignment with the transverse hole in the exposed length portion of the anchor element body.

6. An anchor element as defined in claim 5, wherein said rod positioning recess or recesses, respectively, is a transverse central bore in the anchoring portion of the anchor element body.

7. An anchor element as defined in claim 5, wherein said rod positioning recess or recesses, respectively, is a laterally open recess in a narrow side face of the anchoring portion of the anchor element body. .

8. An anchor element as defined in claim 1, wherein the body of the anchor element has a substantially rectangular cross section;

at least the exposed length portion of the anchor element body is substantially symmetrical with respect to a longitudinal center axis of the anchor element; and the bridge portion of the exposed length portion includes two integral extensions on opposite sides of said center axis, the extensions defining two force-transmitting surfaces facing towards one another, at a distance which is slightly larger than an outside width of the body of the cooperating hoisting shackle.

9. An anchor element as defined in claim 8, wherein the two integral extensions are outwardly aligned with the side edges of the exposed length portion of the anchor element body.

10. An anchor element as defined in claim 8, wherein the anchor element body has a width which tapers in the longitudinal sense from a maximum width at the exposed extremity to a minimum width at the anchoring extremity.

11. An anchor element as defined in claim 8, wherein the anchor element body is a length of a rectangular steel bar, and the two force-transmitting surfaces are oriented substantially parallel to the narrow side faces of the steel bar.

12. An anchor element as defined in claim 8, wherein the bridge portion between said integral extensions is outwardly arched around the transverse hole, the integral extensions reaching a small distance beyond the crest of the arched bridge portion.

13. An attachment mechanism adapted for the tilt-up and transport of heavy building components, such as prefabricated concrete wall members, supporting columns, and the like, which, in the course of manufacture, transportation, and installation, may have to be reoriented from a horizontal to a vertical orientation, or vice versa, the attachment mechanism comprising in combination:

a hoisting shackle having an outwardly generally ring-shaped body with a central opening engageable by a hoisting harness in the manner of a chain link, the body enclosing an arcuate cavity interrupted in its midportion by a radially oriented attachment slot which has a bottom in its radially inner end formed by a connecting bridge of the shackle body; the shackle further including a matching arcuate locking bolt which is guided inside said arcuate cavity for movements between a locked position in which it extends across the attachment slot, and an open position in which it is retracted behind the attachment slot; and an anchor element intended to be permanently attached to the building component through partial embedding therein, the anchor element having an elongated element body of which one length portion is an exposed length portion and the remaining length portion is to serve as an embedded length portion and includes, for that purpose, means for rigidly retaining the anchor element in the building component, when embedded therein; and wherein the exposed portion of the anchor element body forms an eye portion fitting into the attachment slot of the shackle body the eye portion having a transverse hole arranged to be engaged by the locking bolt of the shackle; and the eye portion of the anchor element body further includes at least one integral extension which is oriented towards the connecting bridge of the shackle body, the latter and said extension or extensions, respectively, forming at least one pair of cooperating force-transmitting surfaces which restrict the pivoting freedom of the attached hoisting shackle about the pivot axis defined by the transverse hole of the eye portion and the engaged locking bolt, when the shackle is pulled in a direction which creates such a pivoting tendency.

14. An attachment mechanism as defined in claim 13, wherein the anchor element body has a longitudinal center axis;

the eye portion of said body has an integral extension in line with said center axis and defining two outwardly facing force-transmitting surfaces;

the shackle body has in its connecting bridge a radially extending aperture in alignment with its attachment slot, said aperture defining two inwardly facing force-transmitting surfaces between which the force-transmitting surfaces of the eye portion extension are engaged, when the shackle is attached to the anchor element.

15. An attachment mechanism as defined in claim 14, wherein the radially extending aperture in the connecting bridge of the shackle body reaches therethrough to the central opening of said body.

16. An attachment mechanism as defined in claim 13, wherein the anchor element body has a longitudinal center axis;

the eye portion of said body has two integral extensions on opposite sides of its center axis, the extensions defining two force-transmitting surfaces facing towards one another;

the shackle body has, as part of its connecting bridge, two opposite laterally outwardly facing force-transmitting surfaces which are engaged between the force-transmitting surfaces of the eye portion extensions, when the shackle is attached to the anchor element.

17. An attachment mechanism as defined in claim 16, wherein the width of the shackle body across its outwardly facing force-transmitting surfaces at the connecting bridge is substantially the same as the width of the adjoining portions of the shackle body, where it encloses the arcuate cavity which guides the locking bolt;

the width of the anchor element, in at least its eye portion, is larger than said width across the force-transmitting surfaces of the shackle body by an amount equal to the combined width of the two integral extensions, meaning that the latter are located laterally outside the shackle body, when the shackle is attached to the anchor element.

18. An attachment mechanism as defined in claim 16, wherein the width of the shackle body across its outwardly facing force-transmitting surfaces at the connecting bridge is greater than the width of the adjoining portions of the shackle body.

19. An attachment mechanism as defined in claim 16, wherein the width of the shackle body across its outwardly facing force-transmitting surfaces at the connecting bridge is less than the width of the adjoining portions of the shackle body, where it encloses the arcuate cavity which guides the locking bolt, each force-transmitting surface being the bottom surface of a lateral recess in the connecting bridge;

the two integral extensions of the anchor element eye portion, by having their inwardly facing force-transmitting surfaces cooperate with said force-transmitting surfaces of the shackle body, reach into said lateral recesses.

20. An attachment mechanism as defined in claim 19, wherein the lateral recesses at the connecting bridge of the shackle body have substantially the same width as the attachment slot, the lateral recesses terminating short of the central opening of the shackle body in the radial sense, thereby leaving a portion of the connecting bridge in which the latter is at least as wide as the adjoining portions of the shackle body.

* * * * *